US007364451B2

(12) United States Patent
Ring et al.

(10) Patent No.: US 7,364,451 B2
(45) Date of Patent: Apr. 29, 2008

(54) HYBRID GLASS-SEALED ELECTRICAL CONNECTORS

(76) Inventors: John H. Ring, c/o Kemlon Products & Development Co., Ltd., P.O. Box 2189, Pearland, TX (US) 77588-2189; Russell K. Ring, c/o Kemlon Products & Development Co., Ltd., P.O. Box 2189, Pearland, TX (US) 77588-2189

( * ) Notice: Subject to any disclaimer, the term of this patent is extended or adjusted under 35 U.S.C. 154(b) by 0 days.

(21) Appl. No.: 10/785,576

(22) Filed: Feb. 24, 2004

(65) Prior Publication Data

US 2005/0186823 A1 Aug. 25, 2005

(51) Int. Cl.
*H01R 13/28* (2006.01)

(52) U.S. Cl. ..... 439/271

(58) Field of Classification Search ..... 439/271, 439/274, 272, 275, 276
See application file for complete search history.

(56) References Cited

U.S. PATENT DOCUMENTS

| | | | | |
|---|---|---|---|---|
| 3,793,608 | A | 2/1974 | Ring et al. | 339/61 R |
| 3,898,731 | A | 8/1975 | Ring et al. | 29/629 |
| 4,770,643 | A * | 9/1988 | Castellani et al. | 439/135 |
| 5,017,740 | A * | 5/1991 | Honkomp et al. | 174/152 GM |
| 6,582,251 | B1 | 6/2003 | Burke et al. | 439/589 |
| 6,632,104 | B2 * | 10/2003 | Quadir | 439/587 |
| 6,821,147 | B1 * | 11/2004 | Hall et al. | 439/581 |
| 7,097,501 | B2 * | 8/2006 | Shah | 439/589 |
| 2003/0032339 | A1 * | 2/2003 | Bell et al. | 439/736 |

OTHER PUBLICATIONS

Printout from Kemlon Products and Development Web site (www.kemlon.com) "Technical Information" (attention is also directed to the pages accessed from the "Catalog" link on that same Web site, three pages of which are enclosed, showing a "glass sealed with polyether" connector, "glass bonded ceramic" connector, KEMTHREAD connector, etc.).

Printout from Green, Tweed & Co., Inc. Web site (www.greentweed.com), "The Seal-Connect® Advantage," "Ceramic to Metal Connector Pushes Technology Limits in Smart Well Completion Tools," "Ceramic Metal Connector Systems," "Conductor Materials & Design," Drawing Nos. WEB4805-110 and WEB4805-143, and other drawings and technical information accessed on this Web site.

* cited by examiner

*Primary Examiner*—Chandrika Prasad
(74) *Attorney, Agent, or Firm*—William E. Johnson, Jr.

(57) ABSTRACT

An electrical connector adapted for mounting to an electrical apparatus used in either high pressure or high temperature, or both high temperature and high pressure, applications. A metal body is provided for mounting to the electrical apparatus with at least one conductor for carrying electricity to or from the electrical apparatus extending therethrough and a thermoplastic jacket is applied over the conductors to the end of the metal body that is subjected to either high pressure or high temperature, or both high temperature and high pressure, for sealing around the conductor. An insulative material is interposed between the metal body and the conductor for sealing around the conductor. In addition to providing two independent internal and two independent external seals, the glass-to-metal seal limits cold-flow (creep) of thermoplastic along the pin and through the metal body. This feature effectively eliminates the catastrophic hydraulic failures possible with prior connectors utilizing a pin, metal body, and high temperature thermoplastic. Because of the redundant internal and external seals, the connector provides undistorted electrical performance in the most hostile environments of temperature and pressure.

47 Claims, 4 Drawing Sheets

FIG. 11
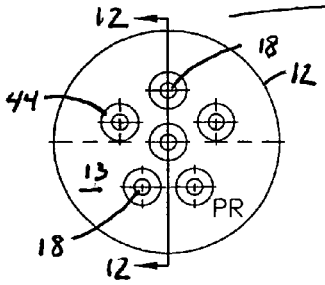
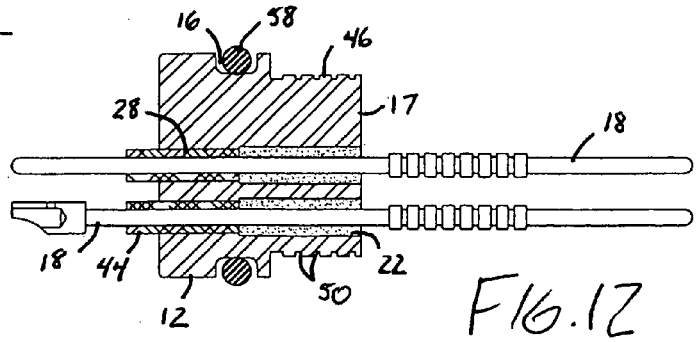
FIG. 12
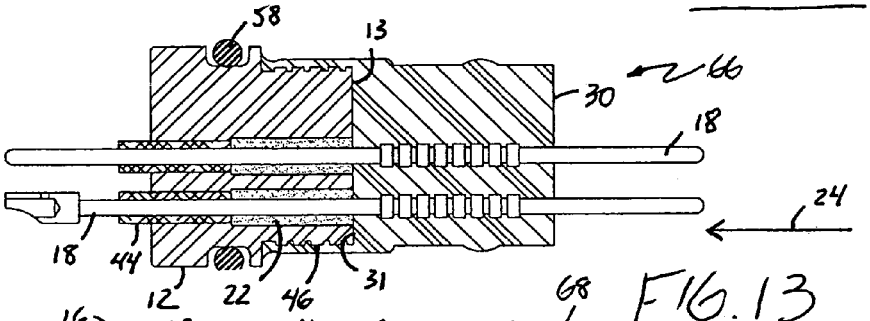
FIG. 13
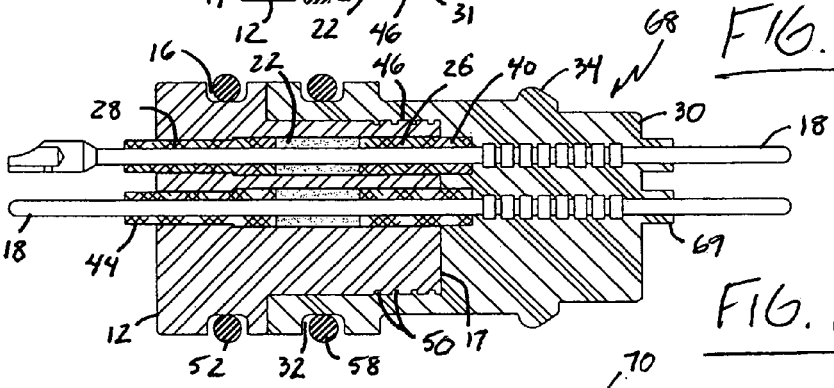
FIG. 14
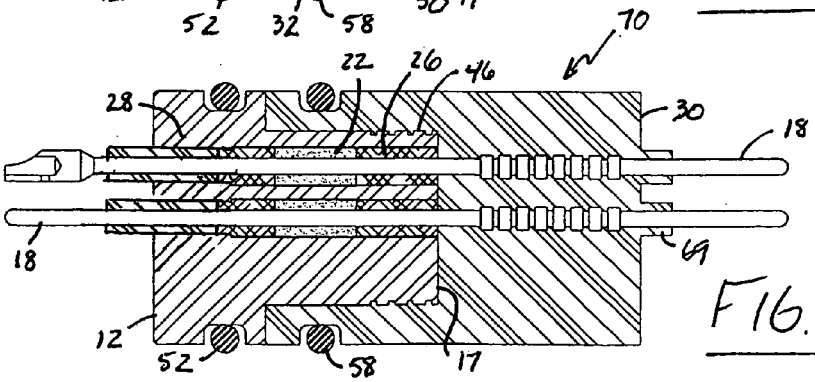
FIG. 15

HYBRID GLASS-SEALED ELECTRICAL CONNECTORS

BACKGROUND OF THE INVENTION

The present invention relates to electrical connectors useful in many applications, but particularly intended for use in hostile environments. More specifically, the present invention relates to single and multi-pin electrical connectors for use in high-pressure, high-temperature applications which commonly occur in the oilfield, but which are also encountered in geothermal and research applications.

Oil wells are being drilled to deeper depths and encountering harsher conditions than in the past. Many of the electrical connectors in the oilfield are exposed to the environment of the open well bore, where at maximum depth, pressures rise to over 30,000 psig, temperatures exceed 500° F., and the natural or chemically-enhanced well bore environment is extremely corrosive. In part because of these conditions, many downhole tools are oil-filled, but regardless of whether the tools are oil- or air-filled, the high temperatures and pressures of oil wells require the use of specially-designed electrical connectors for both power and communication to such tools. Metal connectors with glass seals such as those described in U.S. Pat. No. 3,793,608 were developed for use in these hostile environments. Such connectors are available from a number of vendors, including Kemlon Products and Development Co., Ltd. (Pearland, Tex.), Hermetic Seal, and Deutch and, up until the last five years or so, have given good service. Another variety of connectors, developed by Kemlon Products in the early 1980's and in the early 1990's by Schlumberger Well Services (Houston, Tex.), and currently manufactured by Kemlon Products and by Greene, Tweed (Houston, Tex.), utilizes a thermoplastic housing constructed of very high temperature housing material such as the aromatic polyether ketones (PEEK, PEK, PAEK, and PEKK) and conductors of various metals. However, as wells have gone deeper and simultaneous temperature and pressure conditions have increased, the environment for these connectors has become increasingly hostile, and certain disadvantages and limitations of both types of connectors have come to light.

Existing connectors can fail in at least two ways. The more common failure mode for glass-sealed connectors is caused by the almost inevitable presence of moisture and by well bore chemicals, either of which can cause current to arc, or short, from the conductor to the metal body of the connector. Because glass-sealed connectors utilize a metal shell to house the glass-sealed pin conductors, the presence of moisture in the vicinity of the pins may cause arcing or electrical leakage between pins or from pins to ground. Although expensive because they require that the electrical apparatus be pulled from the well, most such electrical failures are repairable in that the apparatus can be repaired and the connector replaced.

Conditions are improved in connectors in which ceramic insulation extends the insulating distance, or arc path, but the problem is not solved by the use of such materials. Because they are such a precise assembly of different materials, glass to metal sealed connectors are particularly affected by exposure to a wide range of operating temperatures. The effect results from the different coefficients of thermal expansion between the metal and the glass, which can cause cracking of the glass as temperatures increase over a wide range of operating temperatures, i.e., −100° F. to over 500° F. Such temperature ranges are encountered, for instance, in oilfield operations in the Artic, where a tool with many connectors may be put into service at an ambient surface temperature of −100° F. and then lowered 30,000 feet into a "hot" formation deep in the earth. This differential expansion problem was recognized in the afore-mentioned U.S. Pat. No. 3,793,608, and may result in the electrical failure described above.

To address this problem, the ceramic material used to extend the insulation must be chosen to match the glass in thermal expansion. Otherwise, the thermal cycling could break the bond between the glass and the ceramic, presenting a possible arc path between the pin and body at the ceramic glass interface. Ceramic materials are available with thermal expansion coefficients that match the types of glass utilized in such conductors, and that also have desirable dielectric properties and high compressive strengths, but they have low tensile and flexural strengths. Because space limitations frequently require pin patterns that are closely spaced in the connector and the ceramic material is not strong in flexural strength, the extended ceramic may become cracked internally, for instance, when a pin is bent and then straightened out. The damage to the ceramic is almost impossible to detect visually and with the presence of moisture, frequently leads to arcing, electrical leakage, and direct shorts. Further, the short may be unexpected because the connector, or even the electrical apparatus having the connector installed thereon, tested normally on the surface (at room temperature and in a dry environment), but when the electrical apparatus is run downhole, the short suddenly appears.

Previous attempts to improve the glass-sealed, metal connector have met with varying degrees of success. For instance, ceramic materials are known to have excellent dielectric properties, to be very strong in compression (for instance, from high ambient pressure), and to be highly resistant to acid, alkali, water, and organics, and would therefore seem to present an ideal material for inclusion in such connectors. However, ceramics are brittle, and oilfield personnel are not well known for their careful handling of equipment such that connectors including ceramic materials are prone to the kind of electrical failure described above when a pin is bent, for instance. Further, in the higher temperature environments of the wells currently being drilled, even connectors comprised of ceramic materials suffer from the above-characterized problem of differential thermal expansion and the resulting electrical failure.

Another improved version of the glass-sealed, metal connector utilizes a wafer, or cap, comprised of a very high temperature thermoplastic material having favorable dielectric properties (such as PEEK or PEK) that is bonded, or epoxied, to the metal body of the connector to provide a longer arc path, resulting in increased insulation resistance and a more flexible and "forgiving" insulator that is less prone to damage from bending moments exerted on the pin(s). However, in adverse conditions, a problem that has arisen with some connectors having such a plastic "cap" is that it is possible for water to accumulate under the cap. When water accumulates under the cap of such connectors, the water provides an electrically conductive path between the pins and/or between the pins and the metal body that results in an undesired electrical leakage or a distortion in the electrical signal from the electrical apparatus.

Although the second failure node also occurs in connectors other than those that utilize thermoplastic materials, connectors that utilize thermoplastic materials are widely used in the oilfield, and therefore provide a good illustration of the problem. This second failure mode is referred to as hydraulic leakage and is the more disastrous in that it results in serious and expensive damage to the electrical apparatus and, in the case of an electrical apparatus that is a downhole tool or instrument, expensive and embarrassing lost time on the rig floor because the entire tool must be pulled from the well and rebuilt or replaced. Thermoplastic materials are molded at high temperature and pressure and have the very significant advantage of resisting moisture. Arcing distances are naturally greater for a connector of the same geometrical structure because there is no metal body for the pins to short to. Further, a pin that bends may not cause shorting problems because the thermoplastic is flexible and does not easily break or crack. A further advantage of such connectors is that because the conducting pins are sealed to the plastic during the molding process, the moisture does not leak along the pin inside the connector even when pins have been bent and then straightened.

However, a characteristic of thermoplastic materials is that they can be re-molded if later exposed to conditions of temperature and pressure of the type likely to be encountered, for instance, in deep oil wells. Creep, sometimes referred to as cold-flow, occurs when the conditions of temperature and pressure cause a change in the shape of an item. At the extremes found in oilfield applications, temperatures and pressures approach the molding conditions of these high temperature thermoplastics, and cold-flow becomes significant as the plastic extrudes though the spaces between the pin of the connector and the surrounding metallic oil tool housing or connector support plate. In some cases, the molded pin can move enough to cause an interruption in the electrical signal, and in others the plastic flows enough to cause a hydraulic failure. In this failure mode, either through mishandling or because the connector is subjected to conditions that exceed the capabilities of the materials or the construction of the connector, the integrity of the connector is compromised. As a result of such hydraulic failure, the connector becomes the route for the ingress of steam, water, or other fluid(s) from the well bore and into the electrical apparatus, driven by the high downhole pressure, and hence the electrical apparatus is severely damaged or destroyed.

This list of the disadvantages and limitations of known connectors is not intended to be exhaustive, but is intended instead to illustrate some of the difficulties caused by the construction and the materials utilized in such connectors.

As is apparent from this summary of known and/or presently available connectors for hostile applications, there is a need for, and it is an object of the present invention to provide, a connector that maintains favorable electrical performance properties even when utilized in high-pressure, high-temperature applications.

There is also a need for an electrical connector including thermoplastic materials in which the cold flow of the thermoplastic material is restricted, or even prevented, in high-temperature and/or high-pressure environments to provide a primary seal to the bulkhead of the electrical apparatus to which the connector is engaged, on the high pressure side of the connector ahead of the glass-to-metal seal, brazed ceramic seal, or glass-ceramic seal and forming an internal seal between the conductor and the external environmental fluids, and it is an object of the present invention to provide such an apparatus and method.

Another object of the present invention is to provide an electrical connector that provides a long arc path between the metal body of the connector and the central conductor, and maintains the length of that arc path under high-temperature and/or high-pressure conditions, so as provide favorable electrical performance in hostile applications.

Another object of the present invention is to provide an electrical connector that maintains its favorable electrical properties at temperatures and pressures up to and exceeding 500° F. and 30,000 psi.

Another object of the present invention is to provide an electrical connector that maintains its favorable electrical properties at high temperatures and pressures and that includes structure that provides strain relief from bending moments applied to the conductor(s) of the connector.

Yet another object of the present invention is to provide an electrical connector utilizing thermoplastic materials which are press fit, molded over, or shrink fit onto the conductor and in which, to the extent that any cold flow does occur upon exposure of the thermoplastic material to high-temperature and/or high-pressure conditions, the thermoplastic material fills every void around the conductor to improve the insulation properties of the connector.

Another object of the present invention is to provide an electrical connector that combines the hydraulic advantage of the glass-sealed connector with an overmolding of thermoplastic material such as an aromatic polyether ketone having a structure that resists cold flow, moisture, and arcing, and which is capable of operating properly at higher pressures and temperatures than presently known molded thermoplastic connectors.

Other objects, and the advantages, of the present invention will be made clear to those skilled in the art by the following description of the presently preferred embodiments thereof

SUMMARY OF THE INVENTION

These objects are achieved by providing an electrical connector adapted for mounting to or engaging an electrical apparatus used in applications in which the electrical apparatus is subjected to either high pressure or high temperature, or both high temperature and high pressure, comprising a metal body for mounting to the electrical apparatus having at least one conductor extending through the body for carrying electricity to or from the electrical apparatus. An insulative material is interposed between the metal body and the conductor extending through the metal body to seal around the conductor. A thermoplastic jacket is applied, and preferably molded, over the conductor and to the end of the metal body that is subjected to either high pressure or high temperature, or both high temperature and high pressure, for sealing around the conductor and for sealing between the conductor and between the connector and the electrical apparatus when subjected to either high pressure or high temperature, or both high temperature and high pressure.

BRIEF DESCRIPTION OF THE DRAWINGS

FIG. 11 is an end view of a second preferred embodiment of a multiple-pin electrical connector constructed in accordance with the teachings of the present invention.

FIG. 12 is a longitudinal sectional view of the metal body of the multiple pin electrical connector of FIG. 11 taken on the line 12-12 in FIG. 11.

FIG. 13 is a longitudinal sectional view of an electrical connector of FIG. 11 after assembly of the metal body shown in FIG. 12 to a thermoplastic jacket.

FIG. 14 is a longitudinal sectional view of a third preferred embodiment of a multi-pin connector constructed in accordance with the teachings of the present invention.

FIG. 15 is a longitudinal sectional view of a fourth preferred embodiment of a multi-pin connector constructed in accordance with the teachings of the present invention.

DETAILED DESCRIPTION OF THE PREFERRED EMBODIMENTS

Figure 1:
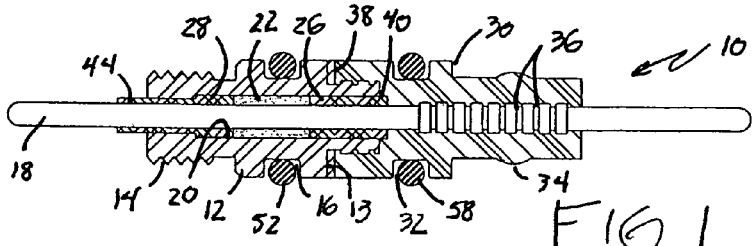
FIG. 1 is a longitudinal sectional view of a preferred embodiment of an electrical connector constructed in accordance with the teachings of the present invention.

Referring to the figures, a first preferred embodiment of an electrical connector constructed in accordance with the teachings of the present invention is indicated generally at reference numeral 10. The connector 10 comprises a metal body 12 that is provided with threads 14 for engaging the bulkhead (not shown) of an electrical apparatus such as a downhole tool or other oilfield equipment. In the embodiment shown in FIG. 1, body 12 is also provided with an annular groove 16 for receiving an O-ring 52, but as will be shown in the description of other embodiments of the connectors constructed in accordance with the present invention set out below, the groove 16 and O-ring 52 may be omitted depending upon the particular application and/or the nature of the electrical apparatus to which the body is engaged. Those skilled in the art will also recognize that the connector 10 need not be engaged to the electrical apparatus by threaded engagement. The connector 10 can also be engaged to the electrical apparatus in other ways, for instance, by welding, tapered threads, and in other ways known in the art. A central conductor 18 extends through an elongate bore 20 in body 12, and in the case of the connector 10 shown in FIG. 1, is sealed in the metal body by the glass 22 in the annulus between the outside diameter (O.D.) of conductor 18 and the inside diameter (I.D.) of the bore 20 in body 12. In all of FIGS. 1-5, pressure is exerted in the direction of the arrow 24 shown in FIG. 4. Additionally, if the threads 14 are sufficiently long to withstand the load from the pressure against O-ring 52, connector 10 can withstand pressure from the reverse direction, or threaded side. In this regard, the connector of the present invention can be utilized in applications requiring pressure from both directions.

In the connector 10 shown in FIG. 1, the annulus between the O.D. of conductor 18 and the I.D. of bore 20 is also filled with ceramic material 26 and 28 on both the pressure and non-pressure sides, respectively, of the glass 22. In addition to providing the usual benefits of ceramics in a connector such as the connector 10 shown in FIG. 1, the ceramic material 26, 28 centralizes the conductor 18 and keeps the glass 22 from running out of the annulus when fired or melted.

A jacket 30 comprised of thermoplastic material is molded over the pressure side of conductor 18. Jacket 30 is provided with an annular groove 32 for receiving O-ring 58 and an optional so-called dogknot 34 for "booted" (no boot is shown) applications. Just as with the metal body 12 and as shown in other embodiments described below, those skilled in the art will recognize that the groove 32 and O-ring 58 may be omitted depending upon the particular application and/or the nature of the electrical apparatus to which the connector 10 is engaged. Jacket 30 is press fit, molded over, or shrink fit over conductor 18; for instance, in a presently preferred embodiment, the thermoplastic material is high pressure molded at temperatures up to 900° F. over the conductor 18. As shown at reference numeral 36, the conductor 18 is provided with a plurality of grooves over which the thermoplastic material is molded so that the thermoplastic material fills the voids as the thermoplastic shrinks during cooling, thereby providing a seal against well bore fluids and electrical insulation between the conductor 18 and the bulkhead of the electrical apparatus. Anti-rotation grooves 38 are provided in the surface 13 of metal body 12 that is opposed to the surface 31 of thermoplastic jacket 30 to resist any tendency of jacket 30 to turn relative to body 12 when in use or during installation and removal.

Figure 2:
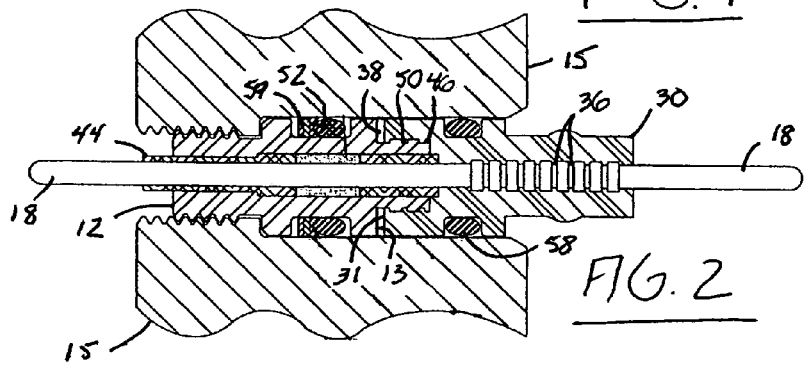
FIG. 2 is a longitudinal sectional view of the electrical connector of FIG. 1 as engaged to an electrical apparatus, such as an oilfield tool.

In FIG. 2, a connector similar to the connector 10 shown in FIG. 1, but with a wider annular groove 16 on the body 12 for receiving a back-up ring 59 in addition to the O-ring 58, is shown threadably engaged to the bulkhead 15 of an electrical apparatus. As used herein, the phrase "electrical apparatus" is intended to refer to any apparatus that operates on electrical current and/or that requires electrical input or output, for instance, from instrumentation in the apparatus. Typical examples of electrical apparatus contemplated by this phrase include downhole oilfield tools, geothermal tools, geological and other earth science research tools, and instrumentation for such tools, but this list is intended to be illustrative and is not intended to limit the type of apparatus with which the connectors of the present invention are utilized. Similarly, the reference herein to the "bulkhead" of the electrical apparatus is not intended to limit the type of tool with which the electrical connectors of the present invention may be utilized. Some other terms that might also be used to describe such structure, depending in part upon the nature of the electrical apparatus contained therein, include the terms "housing," "casing," "wall," and "shell." The O-ring 58 located in the groove 32 on jacket 30 provides the primary seal to the O.D. of the thermoplastic material and an O-ring 58 located in the annular groove 16 in body 12 provides a secondary seal, thus ensuring that the outside diameter of the connector is effectively sealed to bulkhead 15.

Figure 3:
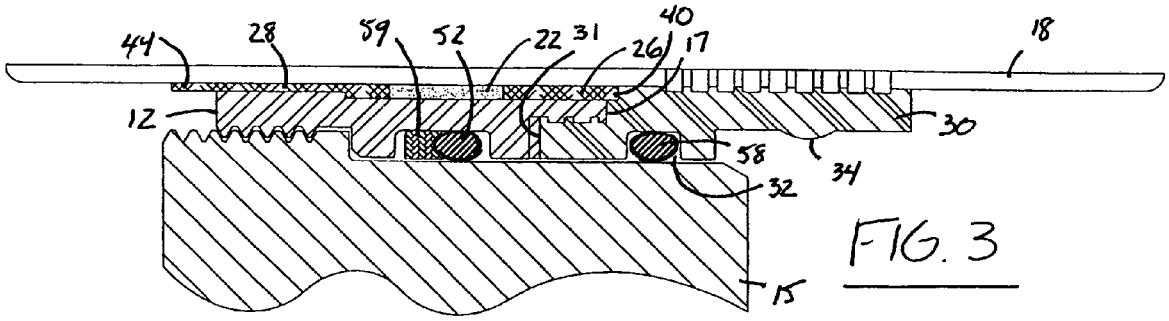
FIG. 3 is an enlarged sectional view of the electrical connector and electrical apparatus shown in FIG. 2 before application of heat, pressure, or heat and pressure.
Figure 4:
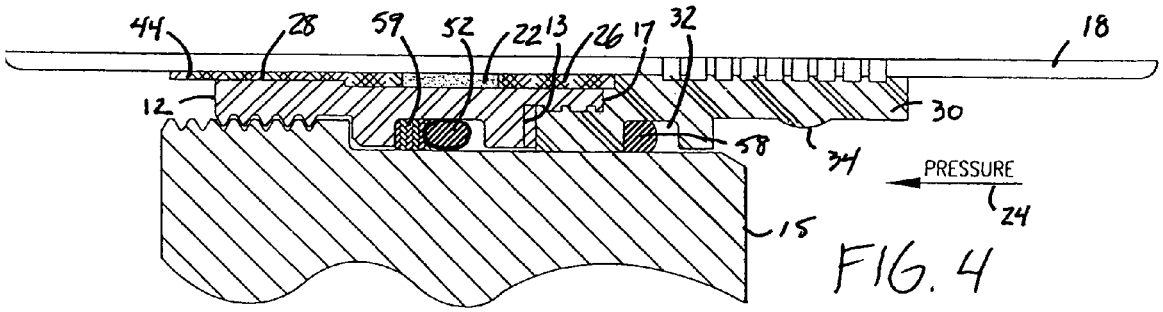
FIG. 4 is an enlarged sectional view similar to the view shown in FIG. 3 but after application of heat, pressure, or heat and pressure.

Referring to FIGS. 3 and 4, which show the connector of FIG. 2 both before (FIG. 3) and after (FIG. 4) application of pressure (or pressure and heat), the manner in which the connector of the present invention utilizes the above-described "re-molding" of the thermoplastic material comprising jacket 30 is illustrated. As shown in FIG. 3, before application of pressure, tolerances between the I.D. of the recess in bulkhead 15 and the O.D. of both metal body 12 and thermoplastic jacket 30 are close enough that the O-rings 52 or 58, and/or the back-up ring 59, are initially energized to seal between the I.D. of the bulkhead 15 and the O.D. of either or both of the metal body 12 or the thermoplastic jacket 30. Upon application of pressure in the direction of arrow 24 in FIG. 4, the back-up ring 59 and O-ring 52 are compressed to seal between the O.D. of body 12 and the I.D. of bulkhead 15. Similarly, O-ring 58 is compressed and seals between the O.D. of jacket 30 and the I.D. of bulkhead 15. As pressure increases and/or heat builds, the thermoplastic material comprising jacket 30 cold flows in the direction toward the surface 13 of metal body 12, but of course the metal body 12 is quite unyielding such that the thermoplastic material comprising jacket 30, being effectively confined by the surface 13 of body 12 and the I.D. of bulkhead 15, tends to expand radially outwardly into sealing contact with the I.D. of bulkhead 15 (compare FIGS. 3 and 4). The grooves 36 in conductor 18 take advantage of the sealing created by the shrinkage of the thermoplastic material comprising jacket 30, and the conductor 18 is hermetically sealed to the metal body 12 by the glass 22. The effect of this design is to provide two different and independent internal seals between the conductor 18 and the external body 12 of connector 10, the first being created by the seal between the thermoplastic material comprising jacket 30 and the pin/conductor 18 and the second being created by the seal between the glass 22, pin 18, and metal body 12. The grooves 36 in conductor 18 take advantage of the sealing created by the shrinkage of the thermoplastic material comprising jacket 30, and the conductor 18 is hermetically sealed to the metal body 12 by the glass 22. Similarly, the design of the connector of the present invention provides separate external seals. The O-ring 58 located in the groove 32 on jacket 30 seals the O.D. of the thermoplastic to bulkhead 15 and O-ring 52 located in the annular groove 16 in body 12 likewise seals between body 12 and bulkhead 15, thus ensuring that the outside of connector 10 is effectively sealed to the bulkhead 15 of the electrical apparatus.

Referring to FIGS. 3 and 4, the portion of the ceramic insulator 26 that extends out of the surface 13 of body 12 that is indicated at reference numeral 40 creates a long arc path between the conductor 18 and the metal body 12. It will also be noted that the glass 22 in the annulus between the O.D. of conductor 18 and the I.D. of bore 20 of the body 12 seals the conductor 18 such that the internal arc path is along the surface 40. The extended length of ceramic 26 provided by the portion 40 shown in FIGS. 3 and 4 constitutes a longer arc path compared to the distance between conductor 18 and body 12 shown in FIGS. 5 and 6, for instance.

The particular metals utilized for the body 12 and conductor 18 are presently utilized in high-pressure, high-temperature connectors, as are the specific ceramics and glass, it being the particular construction of the connector of the present invention that confers it desirable properties. By way of illustration, several grades and alloys of stainless steel, titanium, Inconel, Monel, and others are utilized in the body 12 of connector 10; similarly, conductor 18 may be comprised of Inconel, Monel, Alloy 52, beryllium copper, molybdenum, stainless steel, nickel-iron bearing alloys, and other conductive materials. As known in the art, the particular glass that is utilized is a function of the material comprising the pin and body, it being important to match the coefficients of thermal expansion for the reasons described above and in the above-described U.S. Pat. No. 3,793,608. The particular glass that is utilized is preferably a glass with high volume resistivity to provide good electrical insulation. Similarly, many ceramic materials may be utilized to advantage, the particular ceramic being selected depending upon its resistance to acid, alkali, organic solvents, and/or water, and its dielectric properties. Depending upon the particular application of the connector, it may also be advantageous to utilize a higher strength ceramic material such as a zirconia.

The thermoplastic utilized in jacket 30 is preferably a thermoplastic with most, and preferably all, of the following characteristics: good dielectric properties, extremely high viscosity at the 500+° F. temperatures likely to be encountered in downhole environments, high volume resistivity in this same temperature range, a thermoplastic that maintains its strength in this same temperature range, has low water absorption, is resistant to acids, bases, and solvents, and is non-hydrolyzable. Thermoplastics that have been used to advantage in the jacket 30 include, but are not limited to, aromatic polyether ketones, including polyaryletherketone (PAEK), polyetheretherketone (PEEK), polyetherketone (PEK), and polyetherketoneketone (PEKK), as well as blends of such thermoplastics with other plastic materials, including modifiers and extenders, as well as other polymers.

Figure 5:
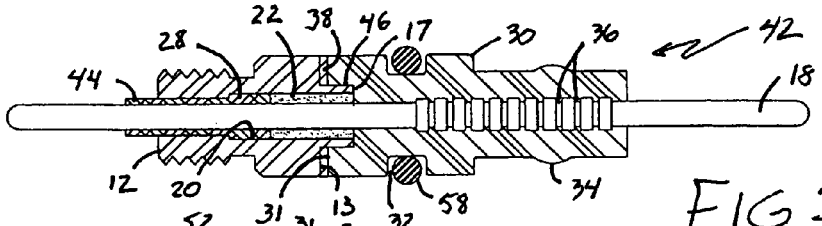
FIG. 5 a longitudinal sectional view of a second preferred embodiment of an electrical connector constructed in accordance with the teachings of the present invention.

Referring now to FIG. 5, a second embodiment of a connector constructed in accordance with the present invention is indicated generally at reference numeral 42. Connector 42 is comprised of the same component parts as connector 10 shown in FIG. 1 such that the same reference numerals are used to designate the common parts of both embodiments, but connector 42 is intended for use in different applications than the connector 10 shown in FIGS. 1-4 in that the metal body 12 of connector 42 lacks a groove such as the groove 16 in the body 12 of connector 10 (FIGS. 1-4) for an O-ring for effecting the above-described seal with the bulkhead (not shown) of the electrical apparatus to which the body 12 is engaged. Another difference between connector 42 and connector 10 can be seen by reference to the annulus between the O.D. of conductor 18 and the I.D. of the bore 20 through metal body 12. Instead of rings of ceramic material on both the high and low pressure sides of the glass seal 22 such as the ceramic insulators 26 and 28 in FIGS. 1-4, the connector 42 shown in FIG. 5 is provided with a single ceramic insulator 28 on the low pressure side of glass seal 22. To reduce cost and to obtain a more secure fit of the opposed surfaces 13, 31 of body 12 and jacket 30, the body 12 is provided with a nipple 46 that extends into an appropriately sized cavity (not numbered) in jacket 30. The glass seal 22 extends around conductor 18 all the way up into nipple 46, but those skilled in the art who have the benefit of this disclosure will recognize that the thermoplastic material comprising jacket 30 can be formed with a complimentary-shaped nipple that extends down into the bore 20 in body 12 into contact with glass 22 even if the glass 22 does not extend up into the nipple 46.

Figure 6:
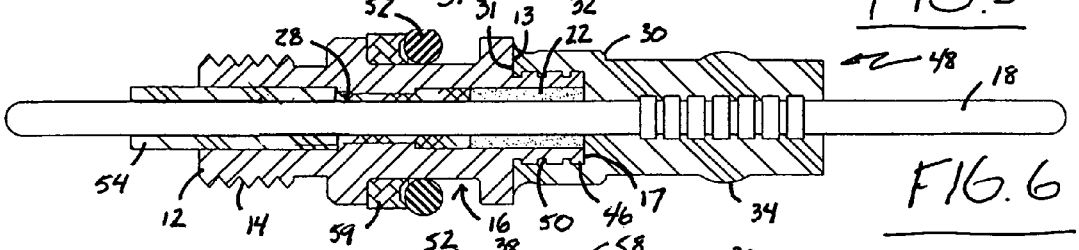
FIG. 6 is a longitudinal sectional view of a third preferred embodiment of an electrical connector constructed in accordance with the teachings of the present invention.

A third embodiment of the connector of the present invention is shown at reference numeral 48 in FIG. 6. In the connector 48, the O.D. of nipple 46 is provided with a plurality of grooves 50 such that, when jacket 30 is overmolded onto body 12, the connection is even more secure than in the connector 42 shown in FIG. 5. By comparison of the connector 48 in FIG. 6 to the connectors 10 and 42 in FIGS. 1-5, it can be seen that no groove is provided for an O-ring on the O.D. of jacket 30 such that the connector 48 seals only to the bulkhead (not shown) of the electrical apparatus to which the metal body 12 is threadably engaged. An O-ring 52 and back-up ring 59 are shown in the groove 16 for that purpose. It can also be seen that the connector 48 is provided with an insulating, flexible sleeve 54 on the low pressure side of the ceramic insulator 28 to provide some flexibility and/or vibration resistance to the connector 48 and to decrease the likelihood of damage to the ceramic insulator 28 from bending forces that might otherwise tend to cause the conductor 18 to move relative to body 12. In the embodiment shown, like the jacket 30, sleeve 54 is comprised of thermoplastic material, but those skilled in the art will recognize that other flexible insulating materials are likewise utilized for this purpose.

Figure 7:
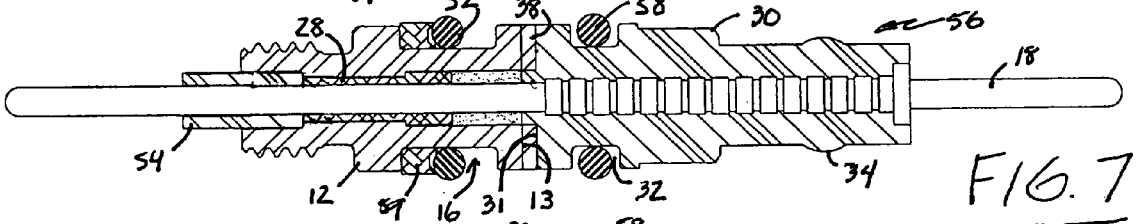
FIG. 7 is a longitudinal sectional view of a fourth preferred embodiment of an electrical connector constructed in accordance with the teachings of the present invention.

A fourth embodiment of a connector constructed in accordance with the present invention is indicated generally at reference 56 in FIG. 7. Both the O-ring 52 in groove 16 and the O-ring 58 in groove 32 for effecting independent primary and secondary seals are shown in FIG. 7. Those skilled in the art who have the benefit of this disclosure will recognize that, although not required in all applications, it may be advantageous to provide back-up rings 59 for better effecting the seal between the O.D. of connector 56 and the bulkhead of the electrical apparatus to which connector 56 is engaged.

Figure 8:
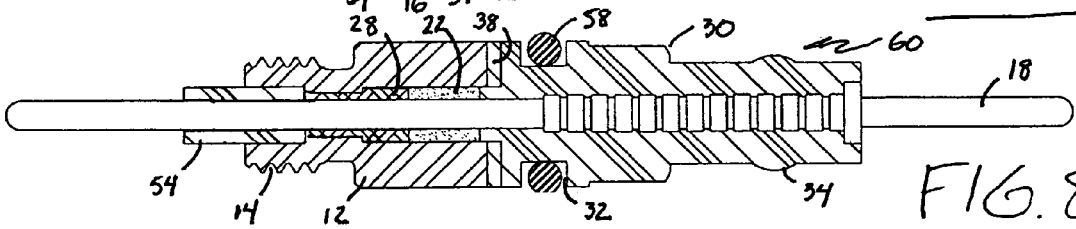
FIG. 8 is a longitudinal sectional view of a fifth preferred embodiment of an electrical connector constructed in accordance with the teachings of the present invention.
Figure 9:
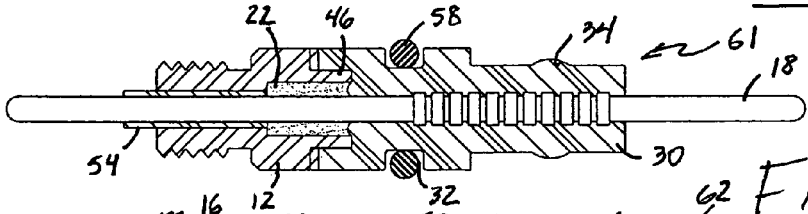
FIG. 9 is a longitudinal sectional view of a sixth preferred embodiment of an electrical connector constructed in accordance with the teachings of the present invention.
Figure 10:
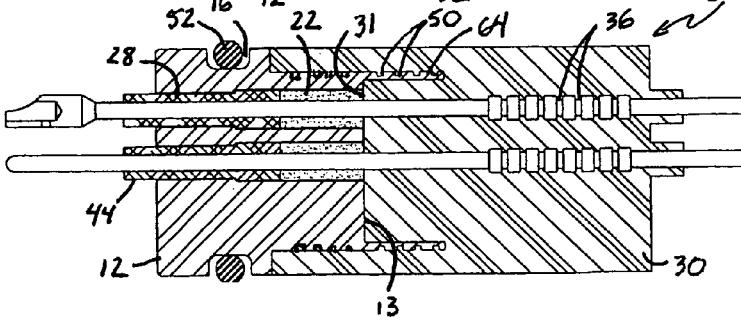
FIG. 10 is a longitudinal sectional view of a preferred embodiment of a multiple-pin, or multi-conductor, electrical connector constructed in accordance with the teachings of the present invention.

By reference to the fifth embodiment of a connector constructed in accordance with the present invention shown at reference numeral 60 in FIG. 8, it can be seen that the connector can also be configured only with an O-ring 58 for effecting a seal between the thermoplastic jacket 30 and the bulkhead of the electrical apparatus to which the connector 60 is engaged. In this regard, connector 60 is configured in the same manner as connector 42 (FIG. 5), but unlike connector 42, connector 60 includes the flexible insulating sleeve 54 shown in the connectors 48 and 56 (FIGS. 6 and 7, respectively). The connector 61 shown in FIG. 9 is likewise provided only with an O-ring 58 for sealing between the thermoplastic comprising jacket 30 and the bulkhead of the electrical apparatus, and also lacks any ceramic such as the ceramic insulators 26 and 28 shown in FIGS. 1-4, being only provided with a flexible sleeve 54 on the low pressure side of glass 22.

The structure and function of the component parts of the connectors shown in FIGS. 1-9 are equally useful when utilized in multi-pin connectors, and several embodiments of multi-pin connectors constructed in accordance with the present invention are shown in FIGS. 10-19, in which like numerals are utilized to designate the component parts shown in the connectors shown in FIGS. 1-9. In a first multi-pin connector constructed in accordance with the present invention, indicated generally at reference numeral 62 in FIG. 10, the connector 62 is provided with multiple conductors 18, each provided with a glass seal 22 and a ceramic insulator 28 on the low pressure side of glass seal 22. It can be seen that the body 12 is provided with a collar 64, similar in function to the nipple 46 of the connectors shown in FIGS. 1-6, such that the surface 13 of body 12 that is opposed to the surface 31 of jacket 30 is, in effect, recessed. The O.D. of collar 64 is provided with a plurality of grooves 50 so that the jacket 30 is securely retained to body 12 when shrink fit to collar 64 and grooves 50 after overmolding or press-fitting over body 12 and cooling. The collar 64 enhances the joining of the thermoplastic material comprising jacket 30 to the body 12 by minimizing stresses due to differences of thermal expansion between the thermoplastic and body materials.

A second embodiment of a multi-conductor connector constructed in accordance with the present invention is indicated generally at reference numeral 66 in FIGS. 11-13. As shown in FIG. 11, connector 66 is provided with six conductors, or pins, 18 and as shown in FIG. 12, connector 66 is similar in construction to connector 10 (FIGS. 1-4 and 6) in that the outside diameter of the nipple 46 of metal body 12 is provided with grooves 50 and the thermoplastic jacket 30 is molded or press-fit over body 12 and cooled to shrink fit over the O.D. of nipple 46 as shown in FIG. 13.

A third embodiment of a multiple-conductor connector constructed in accordance with the present invention is indicated generally at reference numeral 68 in FIG. 14. Connector 68 is provided with ceramic insulators 26, 28 on the high and low pressure sides, respectively, of glass seal 22 in a manner similar to the connector 10 shown in FIGS. 1-4. The thermoplastic jacket 30 of connector 68 is, like the jacket 30 of connector 66 (FIGS. 11-13), engaged to the grooves 50 on the O.D. of nipple 46 by overmolding and/or press-fitting so as to shrink fit the jacket 30 over body 12 in the manner described above. The O-ring 58 residing in the groove 32 in the O.D. of jacket 30 effects a seal to the bulkhead (not shown) of the electrical apparatus to which connector 68 is engaged; the location of the groove 16 and O-ring 52 over the O.D. of body 12 provides a secondary seal to the bulkhead (not shown in FIG. 14), sealing the body 12 and glass-to-metal internal seal, and further limits cold flow of the thermoplastic material comprising jacket 30 in hostile applications. The molded thermoplastic stand-off 69 shown in FIGS. 14 and 15 extends the insulation and increases the arc distance between the conductors 18 and body 12 as compared to the arc distance in a connector such as the connector 66 shown in FIG. 13.

Figure 16:
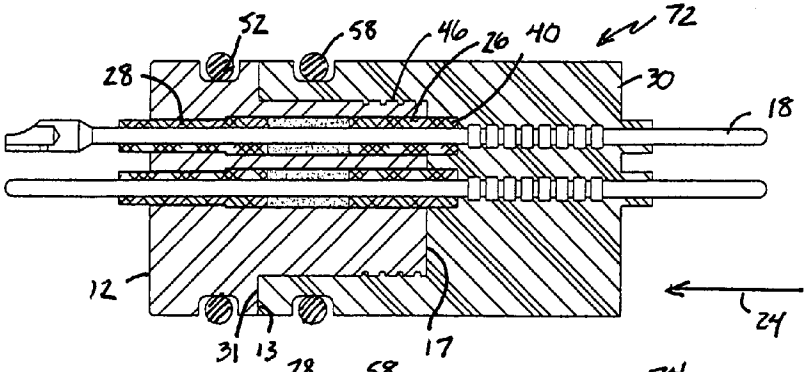
FIG. 16 is a longitudinal sectional view of a fifth preferred embodiment of a multi-pin connector constructed in accordance with the teachings of the present invention.

Referring now to FIG. 15, a fourth embodiment of a multi-conductor connector constructed in accordance with the present invention is indicated generally at reference numeral 70. Embodiment 70 is similar in construction to the embodiment 68 shown in FIG. 14, but the jacket 30 of connector 70 is formed in the shape of a right cylinder and does not include the dogknot 34 (used in conjunction with an elastomeric/rubber boot (not shown)) formed in the O.D. of the jacket 30 of connector 68. Another difference between connector 68 (FIG. 14) and connector 70 (FIG. 15) is that the ceramic insulating insulator 26 around conductors 18 of connector 70 does not extend out of the surface 13 of body 12 into jacket 30 in the manner shown at reference numeral 40 in FIG. 14. Yet another difference between connector 68 (FIG. 14) and connector 70 (FIG. 15) is the addition of the flexible insulator or thermoplastic sleeve 54 on the low-pressure side of metal body 12. A fifth embodiment, connector 72 shown in FIG. 16, is similar in construction to the connector 70 of FIG. 15, but does include the portion 40 of ceramic insulator 26 extending out of the surface 13 of metal body 12 into a complimentary-shaped cavity (not numbered) in the surface 31 of jacket 30.

Figure 17:
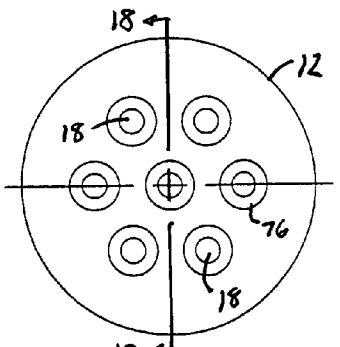
FIG. 17 is an end view of a sixth preferred embodiment of a multi-pin connector constructed in accordance with the teachings of the present invention.
Figure 18:
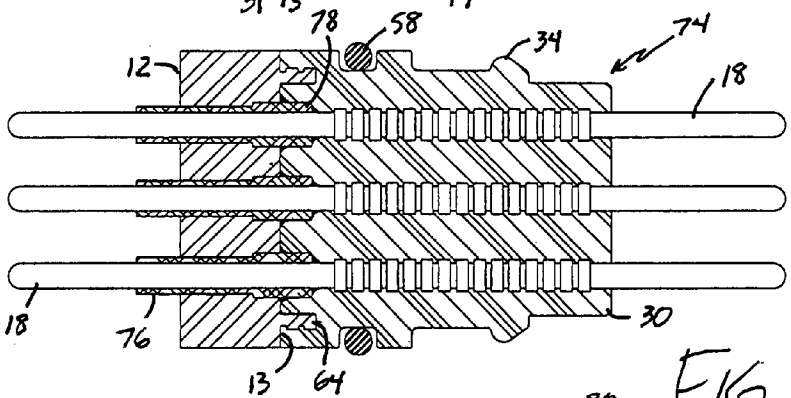
FIG. 18 is a longitudinal sectional view of the multi-pin connector of FIG. 17 taken along the line 18-18 in FIG. 17.
Figure 19:
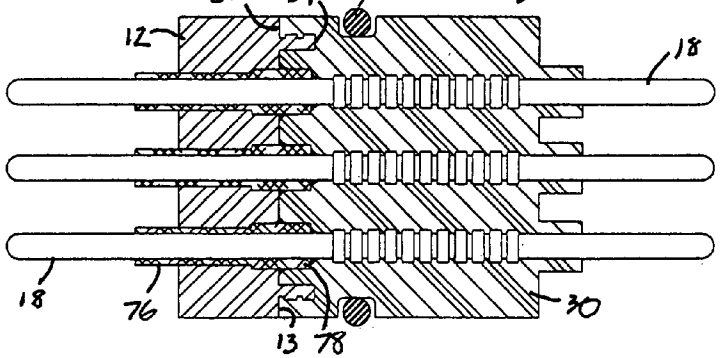
FIG. 19 is a longitudinal sectional view off a seventh preferred embodiment of a multi-pin connector constructed in accordance with the teachings of the present invention.

A sixth embodiment of a multi-conductor connector constructed in accordance with the present invention is indicated generally at reference numeral 74 and 80 in FIGS. 17 and 18. The conductor 18 of connector 74, instead of being insulated from body 12 and sealed with a glass seal and one or more ceramic ring(s), is insulated from body 12 by a combination seal and insulator 76 comprised of a metalized and brazed ceramic material. An O-ring 58 residing in groove 32 on jacket 30 provides the above-described seal of the connector 74 to the bulkhead and the brazed metalized ceramic provides an internal seal between the metal body 12 and conductor 18 in the same manner as described above in connection with the connectors shown in FIGS. 1-16. Overmolding or press-fitting the portion 78 of ceramic insulator 76 that extends from the surface 13 of body 12 with the thermoplastic jacket 30 provides durability to a material that is otherwise so brittle that the bending of a conductor 18 would result in hydraulic failure.

Those skilled in the art who have the benefit of this disclosure will recognize that certain changes can be made to the component parts of the apparatus of the present invention without changing the manner in which those parts function to achieve their intended result. For instance, some of the various connectors shown in FIGS. 1-19 include two O-rings while others include only one, and it will be recognized from this disclosure by those skilled in the art that any of the various embodiments shown herein may or may not include an O-ring on the jacket 30, an O-ring on the body 12, O-rings on both jacket 30 and body 12, or no O-rings at all. Seals between the metal body and the electrical apparatus to which it is engaged can also be effected by welding (electron-beam, laser, or other weld), using tapered interference threads, or an "autoclave" style metal-to-metal seal. Similarly, it will be noted by those skilled in the art that the longer the arc path between conductor 18 and body 12, the more likely the connector will retain its desirable insulative properties such that those skilled in the art will recognize that any of the embodiments shown herein can be constructed with a glass, glass-ceramic, or ceramic insulator that provides a long arc path. In addition, those skilled in the art will recognize that where ceramic insulators are exposed as depicted in connectors 10 and 66, for instance, an embodiment utilizing an exposed thermoplastic sleeve such as is shown at reference numeral 54 or flexible insulator comprised of other materials as known in the art can be supplied as in connectors 48, 56, 61, and 70. All such changes, and others which will be clear to those skilled in the art from this description of the preferred embodiments of the invention, are intended to fall within the scope of the following, non-limiting claims.

What is claimed is:

1. A connector adapted for mounting to an electrical apparatus which can be moved through an earth borehole having either high pressure or high temperature, or both high temperature and high pressure, comprising:

an electrical conductor;

a metal body having first and second ends, and having a given length between said first and second ends, said metal body adapted to be connected to an electrical apparatus, said electrical conductor extending through said metal body, said metal body having an annulus surrounding the said electrical conductor along the entire given length of said metal body;

an insulation seal in said annulus, said seal comprising, at least in part, a layer of glass surrounding said electrical conductor, said insulation seal at least partially insulating said metal body, thereby insulating said metal body from said electrical conductor, said glass having a melting point greater than 500° F.; and a thermoplastic jacket applied in an initial position over and touching the electrical conductor and touching said metal body, and movable to a second, radially outwards position for sealing against the electrical apparatus when subjected to either high temperature or high pressure, or both high temperature and high pressure.

2. The connector according to claim 1, wherein the coefficient of thermal expansion of the said metal body substantially matches the coefficient of thermal expansion of the said electrical conductor.

3. The connector according to claim 2, wherein the coefficient of thermal expansion of the glass layer substantially matches the coefficients of thermal expansion of the metal body and of the electrical conductor.

4. The connector according to claim 1, wherein said glass layer continues to insulate the electrical conductor from the metal body even when exposed to earth borehole pressures exceeding 30,000 psig.

5. The connector of claim 1, wherein said thermoplastic jacket is applied by overmolding or press-fitting said jacket over said metal body having the conductor extending therethrough.

6. The connector of claim 1, wherein said thermoplastic jacket is comprised of an aromatic polyether ketone.

7. The connector of claim 1, wherein said thermoplastic material is selected from the group consisting of PEK, PEEK, PAEK, and PEKK and blends of PEK, PEEK, PAEK, and PEKK with other plastics, modifiers, extenders, and polymers.

8. The connector of claim 1, wherein said thermoplastic jacket is comprised of a thermoplastic that is non-hydrolyzable and resistant to high temperature wellbore fluids, acids, and solvents, maintains favorable dielectric properties and volume resistivity at high temperatures, and retains high viscosity at high temperature and pressure.

9. A connector adapted for mounting to an electrical apparatus which can be moved through an earth borehole having either high pressure or high temperature, or both high temperature and high pressure, comprising:

a plurality of electrical conductors;

a metal body having first and second ends, and having a given length between said first and second ends, said metal body adapted to be connected to an electrical apparatus, each of said electrical conductors extending through said metal body, said metal body having a plurality of annulus surrounding said plurality of electrical conductors, respectively, each of said electrical conductors having its own annulus surrounding each of the said electrical conductors, respectively, along the entire given length of said metal body;

an insulation seal in each said annulus, said seals each comprising, at least in part, a layer of glass surrounding one of said electrical conductors, respectively, insulating said metal body from said electrical conductors, each of said glass layers having a melting point greater than 500° F.; and a thermoplastic jacket applied in an initial position over and touching the electrical conductors and touching said metal body, and movable to a second, radially outwards position for sealing against the electrical apparatus when subjected to either high temperature or high pressure, or both high temperature and high pressure.

10. The connector of claim 9, wherein said thermoplastic jacket is applied by overmolding or press-fitting said jacket over said metal body having the conductor extending therethrough.

11. The connector of claim 9, wherein said thermoplastic jacket is comprised of an aromatic polyether ketone.

12. The connector of claim 9, wherein said thermoplastic material is selected from the group consisting of PEK, PEEK, PAEK, and PEKK and blends of PEK, PEEK, PAEK, and PEKK with other plastics, modifiers, extenders, and polymers.

13. The connector of claim 9, wherein said thermoplastic jacket is comprised of a thermoplastic that is non-hydrolyzable and resistant to high temperature wellbore fluids, acids, and solvents, maintains favorable dielectric properties and volume resistivity at high temperatures, and retains high viscosity at high temperature and pressure.

14. A connector adapted for mounting to an electrical apparatus which can be moved through an earth borehole having either high pressure or high temperature, or both high temperature and high pressure, comprising:

an electrical conductor;

a metal body having first and second ends, and having a given length between said first and second ends, said metal body adapted to be connected to an electrical apparatus, said electrical conductor extending through said metal body, said metal body having an annulus surrounding the said electrical conductor along the entire given length of said metal body; and an insulation seal in said annulus, said seal comprising, at least in part, a layer of glass and at least one ceramic insulating layer, separate from said layer of glass, said at least one ceramic layer and said glass layer each being in contact with said electrical conductor, said insulation seal having a combined length greater than said given length of said metal body, thereby insulating said metal body from said electrical conductor.

15. The connector according to claim 14, comprising in addition thereto, a thermoplastic jacket applied in an initial position over and touching the electrical conductors and touching said metal body, and movable to a second, radially outwards position for sealing against the electrical apparatus when subjected to either high temperature or high pressure, or both high temperature and high pressure.

16. The connector of claim 15, wherein said thermoplastic jacket is applied by overmolding or press-fitting said jacket over said metal body having the conductor extending therethrough.

17. The connector of claim 15, wherein said thermoplastic jacket is comprised of an aromatic polyether ketone.

18. The connector of claim 15, wherein said thermoplastic material is selected from the group consisting of PEK, PEEK, PAEK, and PEKK and blends of PEK, PEEK, PAEK, and PEKK with other plastics, modifiers, extenders, and polymers.

19. The connector of claim 15, wherein said thermoplastic jacket is comprised of a thermoplastic that is non-hydrolyzable and resistant to high temperature wellbore fluids, acids, and solvents, maintains favorable dielectric properties and volume resistivity at high temperatures, and retains high viscosity at high temperature and pressure.

20. A connector adapted for mounting to an electrical apparatus which can be moved through an earth borehole having either high pressure or high temperature, or both high temperature and high pressure, comprising:

a plurality of electrical conductors;

a metal body having first and second ends, and having a given length between said first and second ends, said metal body adaptor to be connected to an electrical apparatus, each of said electrical conductors extending through said metal body, each of said electrical conductors having an annulus surrounding the said electrical conductors, respectively, along the entire given length of said metal body; and an insulation seal in each said annulus, said seals each comprising, at least in part, a layer of glass and at least one ceramic insulating layer, wherein the glass layer and the at least one ceramic layer in each of said seals are separate from each other, wherein each of said layers in any given seal are in contact with one of the conductors, respectively, said insulation seals each having a combined length greater than said given length of said metal body, thereby insulating said metal body from said electrical conductors.

21. The connector according to claim 20, comprising in addition thereto, a thermoplastic jacket applied in an initial position over and touching the electrical conductors and touching said metal body, and movable to a second, radially outwards position for sealing against the electrical apparatus when subjected to either high temperature or high pressure, or both high temperature and high pressure.

22. The connector of claim 21, wherein said thermoplastic jacket is applied by overmolding or press-fitting said jacket over said metal body having the conductor extending therethrough.

23. The connector of claim 21, wherein said thermoplastic jacket is comprised of an aromatic polyether ketone.

24. The connector of claim 21, wherein said thermoplastic material is selected from the group consisting of PEK, PEEK, PAEK, and PEKK and blends of PEK, PEEK, PAEK, and PEKK with other plastics, modifiers, extenders, and polymers.

25. The connector of claim 21, wherein said thermoplastic jacket is comprised of a thermoplastic that is non-hydrolyzable and resistant to high temperature wellbore fluids, acids, and solvents, maintains favorable dielectric properties and volume resistivity at high temperatures, and retains high viscosity at high temperature and pressure.

26. A connector adapted for mounting to an electrical apparatus which can be moved through an earth borehole having either high pressure or high temperature, or both high temperature and high pressure, comprising:

an electrical conductor;

a metal body having first and second ends, and having a given length between said first and second ends, said metal body adapted to be connected to an electrical apparatus, said electrical conductor extending through said metal body, said metal body having an annulus surrounding the said electrical conductor along the entire given length of said metal body; and an insulation seal in said annulus, said seal comprising, at least in part, a layer of glass surrounding said electrical conductor, said insulation seal at least partially insulating said metal body, thereby insulating said metal body from said electrical conductor, said glass having a melting point greater than 500° F., said insulation seal also comprising at least one ceramic insulating layer, separate from said layer of glass, said at least one ceramic layer and said glass layer each being in contact with said electrical conductor.

27. The connector according to claim 26, comprising in addition thereto, a thermoplastic jacket applied in an initial position over and touching the electrical conductor and touching said metal body, and movable to a second, radially outwards position for sealing against the electrical apparatus when subjected to either high temperature or high pressure, or both high temperature and high pressure.

28. The connector of claim 27, wherein said thermoplastic jacket is applied by overmolding or press-fitting said jacket over said metal body having the conductor extending therethrough.

29. The connector of claim 27, wherein said thermoplastic jacket is comprised of an aromatic polyether ketone.

30. The connector of claim 27, wherein said thermoplastic material is selected from the group consisting of PEK, PEEK, PAEK, and PEKK and blends of PEK, PEEK, PAEK, and PEKK with other plastics, modifiers, extenders, and polymers.

31. The connector of claim 27, wherein said thermoplastic jacket is comprised of a thermoplastic that is non-hydrolyzable and resistant to high temperature wellbore fluids, acids, and solvents, maintains favorable dielectric properties and volume resistivity at high temperatures, and retains high viscosity at high temperature and pressure.

32. A connector adapted for mounting to an electrical apparatus which can be moved through an earth borehole having either high pressure or high temperature, or both high temperature and high pressure, comprising:

a plurality of electrical conductors;

a metal body having first and second ends, and having a given length between said first and second ends, said metal body adapted to be connected to an electrical apparatus, each of said electrical conductors extending through said metal body, said metal body having a plurality of annulus surrounding said plurality of electrical conductors, respectively, each of said electrical conductors having its own annulus surrounding each of the said electrical conductors, respectively, along the entire given length of said metal body; and an insulation seal in each said annulus, said seals each comprising, at least in part, a layer of glass surrounding one of said electrical conductors, respectively, insulating said metal body from said electrical conductors, each of said glass layers having a melting point greater than 500° F., each of said seals also comprising at least one insulating ceramic layer, wherein the glass layer and the at least one ceramic layer in each of said seals are separate from each other, wherein each of said layers in any given seal are in contact with one of the conductors, respectively.

33. The connector according to claim 32, comprising in addition thereto, a thermoplastic jacket applied in an initial position over and touching the electrical conductors and touching said metal body, and movable to a second, radially outwards position for sealing against the electrical apparatus when subjected to either high temperature or high pressure, or both high temperature and high pressure.

34. The connector of claim 33, wherein said thermoplastic jacket is applied by overmolding or press-fitting said jacket over said metal body having the conductor extending therethrough.

35. The connector of claim 33, wherein said thermoplastic jacket is comprised of an aromatic polyether ketone.

36. The connector of claim 33, wherein said thermoplastic material is selected from the group consisting of PEK, PEEK, PAEK, and PEKK and blends of PEK, PEEK, PAEK, and PEKK with other plastics, modifiers, extenders, and polymers.

37. The connector of claim 33, wherein said thermoplastic jacket is comprised of a thermoplastic that is non-hydrolyzable and resistant to high temperature wellbore fluids, acids, and solvents, maintains favorable dielectric properties and volume resistivity at high temperatures, and retains high viscosity at high temperature and pressure.

38. A connector adapted for mounting to an electrical apparatus which can be moved through an earth borehole having either high pressure or high temperature, or both high temperature and high pressure, comprising:

an electrical conductor;

a metal body having first and second ends, and having a given length between said first and second ends, said metal body adapted to be connected to an electrical apparatus, said electrical conductor extending through said metal body, said metal body having an annulus surrounding the said electrical conductor along the entire given length of said metal body;

an insulation seal in said annulus, said seal comprising, at least in part, a layer of glass, said layer of glass being in contact with said electrical conductor, said insulation seal having a combined length greater than said given length of said metal body, thereby insulating said metal body from said electrical conductor; and a thermoplastic jacket applied in an initial position over and touching the electrical conductor and touching said metal body, and movable to a second, radially outwards position for sealing against the electrical apparatus when subjected to either high temperature or high pressure, or both high temperature and high pressure.

39. The connector of claim 38, wherein said thermoplastic jacket is applied by overmolding or press-fitting said jacket over said metal body having the conductor extending therethrough.

40. The connector of claim 38, wherein said thermoplastic jacket is comprised of an aromatic polyether ketone.

41. The connector of claim 38, wherein said thermoplastic material is selected from the group consisting of PEK, PEEK, PAEK, and PEKK and blends of PEK, PEEK, PAEK, and PEKK with other plastics, modifiers, extenders, and polymers.

42. The connector of claim 38, wherein said thermoplastic jacket is comprised of a thermoplastic that is non-hydrolyzable and resistant to high temperature wellbore fluids, acids, and solvents, maintains favorable dielectric properties and volume resistivity at high temperatures, and retains high viscosity at high temperature and pressure.

43. A connector adapted for mounting to an electrical apparatus which can be moved through an earth borehole having either high pressure or high temperature, or both high temperature and high pressure, comprising:

a plurality of electrical conductors;

a metal body having first and second ends, and having a given length between said first and second ends, said metal body adaptor to be connected to an electrical apparatus, each of said electrical conductors extending through said metal body, each of said electrical conductors having an annulus surrounding the said electrical conductors, respectively, along the entire given length of said metal body;

an insulation seal in each said annulus, said seals comprising, at least in part, a layer of glass, wherein said layer of glass is in contact with one of the conductors, respectively, said insulation seals each having a combined length greater than said given length of said metal body, thereby insulating said metal body from said electrical conductors; and a thermoplastic jacket applied in an initial position over and touching the electrical conductors and touching said metal body, and movable to a second, radially outwards position for sealing against the electrical apparatus when subjected to either high temperature or high pressure, or both high temperature and high pressure.

44. The connector of claim 43, wherein said thermoplastic jacket is applied by overmolding or press-fitting said jacket over said metal body having the conductor extending therethrough.

45. The connector of claim 43, wherein said thermoplastic jacket is comprised of an aromatic polyether ketone.

46. The connector of claim 43, wherein said thermoplastic material is selected from the group consisting of PEK, PEEK, PAEK, and PEKK and blends of PEK, PEEK, PAEK, and PEKK with other plastics, modifiers, extenders, and polymers.

47. The connector of claim 43, wherein said thermoplastic jacket is comprised of a thermoplastic that is non-hydrolyzable and resistant to high temperature wellbore fluids, acids, and solvents, maintains favorable dielectric properties and volume resistivity at high temperatures, and retains high viscosity at high temperature and pressure.

* * * * *